US007040731B2

(12) United States Patent
Tsai et al.

(10) Patent No.: US 7,040,731 B2
(45) Date of Patent: May 9, 2006

(54) METHOD OF ADJUSTING THE VELOCITY OF A PRINTHEAD CARRIAGE ACCORDING TO THE TEMPERATURE OF THE PRINTHEAD

(75) Inventors: Sheng-Lung Tsai, Ping-Tung Hsien (TW); Chi-Lun Chen, Hsin-Chu Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 221 days.

(21) Appl. No.: 10/707,936

(22) Filed: Jan. 26, 2004

(65) Prior Publication Data

US 2005/0162454 A1 Jul. 28, 2005

(51) Int. Cl.
*B41J 29/38* (2006.01)

(52) U.S. Cl. ..... 347/17

(58) Field of Classification Search ..... 347/17
See application file for complete search history.

(56) References Cited

U.S. PATENT DOCUMENTS 4,544,931 A * 10/1985 Watanabe et al. ..... 347/17
6,076,981 A * 6/2000 Hayama et al. ..... 400/120.09
6,452,618 B1 9/2002 Heim ..... 347/140

* cited by examiner

*Primary Examiner*—K. Feggins
*Assistant Examiner*—Rene Garcia, Jr.
(74) *Attorney, Agent, or Firm*—Winston Hsu

(57) ABSTRACT

A method for controlling printing quality in an inkjet printer having a printhead with a plurality of nozzles. The printhead is mounted in a carriage, and the carriage is moved to repeatedly pass the printhead across a print medium in individual swaths. The method includes firing individual nozzles repeatedly during each swath to apply an ink pattern to the print medium, measuring the temperature of the printhead prior to each swath, comparing the temperature of the printhead to at least one reference temperature, and if the temperature of the printhead is greater than the reference temperature, raising the velocity of the carriage during the upcoming swath for ensuring that a distance ink is ejected from the printhead to the print medium is kept substantially constant during each swath.

13 Claims, 8 Drawing Sheets

53

| Lower Temp | Upper Temp | Velocity |
|---|---|---|
| Temp1 | Temp2 | Vel1 |
| Temp2 | Temp3 | Vel2 |
| Temp3 | Temp4 | Vel3 |
| Temp4 | Temp5 | Vel4 |
| Temp5 | Temp6 | Vel5 |
| Temp6 | Temp7 | Vel6 |

Fig. 6

METHOD OF ADJUSTING THE VELOCITY OF A PRINTHEAD CARRIAGE ACCORDING TO THE TEMPERATURE OF THE PRINTHEAD

BACKGROUND OF INVENTION

1. Field of the Invention

The present invention relates to inkjet printers, and more specifically to a method for improving print quality by increasing the velocity of the printhead carriage when the temperature of the printhead increases.

2. Description of the Prior Art

Ink-jet printers operate by sweeping a printhead with one or more ink-jet nozzles above a print medium and applying a precise quantity of ink from specified nozzles as they pass over specified pixel locations on the print medium. One type of ink-jet nozzle utilizes a small resistor to produce heat within an associated ink chamber. To fire a nozzle, a voltage is applied to the resistor. The resulting heat causes ink within the chamber to quickly expand, thereby forcing one or more droplets from the associated nozzle. Resistors are controlled individually for each nozzle to produce a desired pixel pattern as the printhead passes over the print medium.

To achieve higher pixel resolutions, printheads have been designed with large numbers of nozzles. This has created the potential for printhead overheating. Each nozzle firing produces residual heat. If too many nozzles are fired within a short period of time, the ink will become less viscous and will eject from the printhead at a higher velocity.

Please refer to FIG. 1. FIG. 1 is a diagram illustrating how an ink drop 12 is ejected from a printhead 10 of the prior art during normal conditions. The printhead 10 is moved across a print medium at a velocity Vp. As the printhead 10 moves across the print medium, the printhead 10 ejects a plurality of ink drops 12 at a drop out velocity Vd. Using vector addition to add the printhead velocity Vp and the drop out velocity Vd, each ink drop 12 is effectively ejected from the printhead 10 with a total velocity V at an angle θ from the vertical. A distance from the printhead 10 to the surface of the print medium is labeled as distance S. From the time that the ink drop 12 is ejected from the printhead 10 to the time that the ink drop 12 reaches the surface of the print medium, the ink drop 12 has traveled a total distance d.

Please refer to FIG. 2. FIG. 2 illustrates operation of the printhead 10 over time during normal conditions. Four different time intervals T1, T2, T3, and T4 are shown in FIG. 2 to show how the ink drop 12 is ejected from the printhead 10 in succeeding time intervals when the ink in the printhead 10 is not excessively heated. Because the temperature of the printhead is at an acceptable level for each of the four time intervals T1, T2, T3, and T4, the velocity V with which the ink drops 12 are ejected is the same for each time interval. That is, the viscosity of the ink in the printhead 10 is substantially constant for each time interval. Since the viscosity is the same in each time interval, the drop out velocity Vd is also the same for each time interval. The velocity Vp with which the printhead 10 moves is kept constant. Therefore, as long as the drop out velocity Vd is kept constant, the distance d that the ink drops 12 are ejected is also the same for each time interval.

Please refer to FIG. 3. FIG. 3 illustrates operation of the printhead 10 over time as the temperature of the printhead 10 rises. In each of the time intervals T1–T4 shown in FIG. 3, the velocity Vp with which the printhead 10 is moving is constant and the distance S from the printhead 10 to the print medium is also constant. However, as the temperature of the printhead 10 increases over the time intervals T1–T4, the viscosity of the ink in the printhead 10 also increases. As a result, the drop out velocity is no longer constant. In time interval T1, the ink in the printhead head 10 is at a low temperature, and the ink drop 12 is ejected with a drop out velocity Vd1 perpendicular from the printhead 10. Combining the velocity Vp of the printhead 10 with the drop out velocity Vd1, the ink drop 12 is effectively ejected from the printhead 10 with a total velocity V1 at an angle $\theta_1$ from the vertical. Therefore, the ink drop 12 travels a total distance d1 before reaching the print medium.

As the printhead 10 continues to heat up over time intervals T2–T4, the printhead 10 ejects ink drops 12 at drop out velocities of Vd2, Vd3, and Vd4 respectively. Unfortunately, since the total velocities V2, V3, and V4 are all different from each other in the different time intervals, the distances d2, d3, and d4 that the ink drops 12 travel are also different. This difference in distances leads to a degradation of print quality, as will be shown below.

Please refer to FIG. 4 with reference to FIG. 3. FIG. 4 is a diagram showing degradation of print quality as the temperature of the printhead 10 increases. A total of eight print swaths Swath1–Swath8 are made on a print medium 20 shown in FIG. 4. As indicated by the vertical axis, the print medium 20 is advanced in an upward direction as succeeding print swaths are made. The printhead 10 ejects ink drops 12 onto the print medium 20 as the printhead 10 moves from left to right. Since the temperature of the printhead 10 is increasing with each subsequent print swath, the distance that the ink drops 12 travel from the printhead 10 to the print medium 20 decreases with each subsequent print swath. This is analogous to the decrease in distances d1–d4 over time intervals T1–T4 in FIG. 3. Due to the distances getting shorter with each swath, the image printed on the print medium 20 appears to shift gradually to the left with each succeeding print swath, and print quality suffers as a result.

SUMMARY OF INVENTION

It is therefore an objective of the claimed invention to provide a method for keeping the distance that ink drops are ejected from a printhead sufficiently constant as the printhead heats up in order to solve the above-mentioned problems.

According to the claimed invention, a method for controlling printing quality in an inkjet printer having a printhead with a plurality of nozzles is disclosed. The printhead is mounted in a carriage, and the carriage is moved to repeatedly pass the printhead across a print medium in individual swaths. The method includes firing individual nozzles repeatedly during each swath to apply an ink pattern to the print medium, measuring the temperature of the printhead prior to each swath, comparing the temperature of the printhead to at least one reference temperature, and if the temperature of the printhead is greater than the reference temperature, raising the velocity of the carriage during the upcoming swath for ensuring that a distance ink is ejected from the printhead to the print medium is kept substantially constant during each swath.

It is an advantage of the claimed invention that the velocity of the printhead is adjusted as the temperature of the printhead changes for keeping the distance that ink is ejected considerably constant for maintaining the quality of printed images.

These and other objectives of the claimed invention will no doubt become obvious to those of ordinary skill in the art after reading the following detailed description of the preferred embodiment, which is illustrated in the various figures and drawings.

BRIEF DESCRIPTION OF DRAWINGS

FIG. 6 is a lookup table stored in a memory of the inkjet printer.

DETAILED DESCRIPTION

To compensate for the variation in the drop out velocity of ink ejected from the printhead, the present invention adjusts the velocity of the carriage in which the printhead is mounted. By adjusting the velocity of the carriage in response to a change in the temperature of the printhead, the ink will be ejected from the printhead at a substantially constant angle and will be ejected for an approximately constant distance no matter what the temperature of the printhead is.

Figure 5:
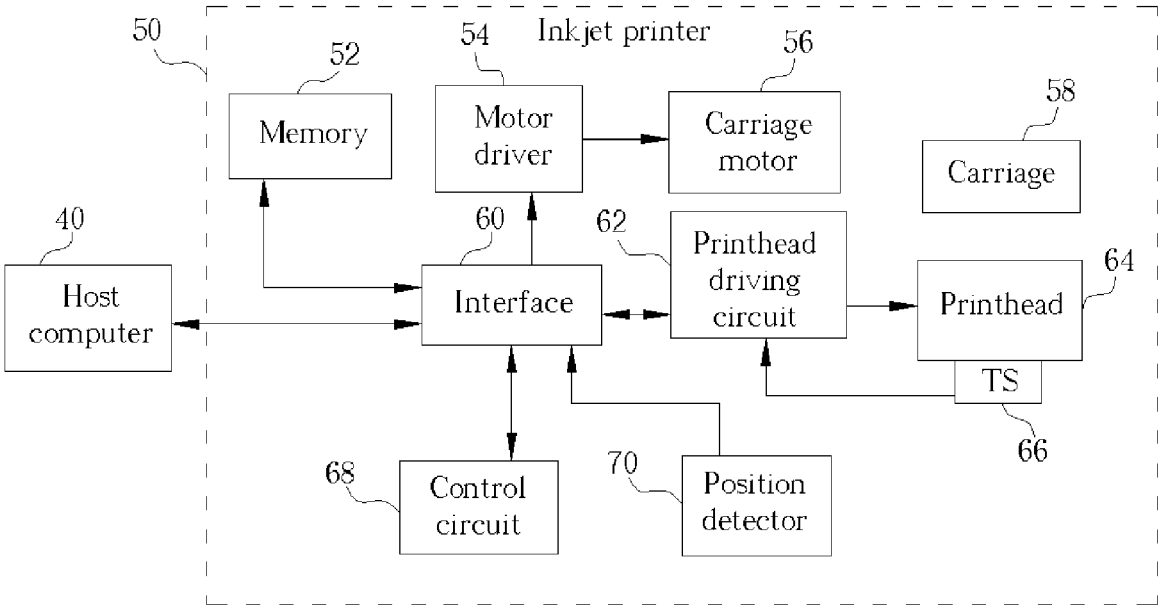
FIG. 5 is a functional block diagram of an inkjet printer according to the present invention.

Please refer to FIG. 5. FIG. 5 is a functional block diagram of an inkjet printer 50 according to the present invention. The inkjet printer 50 contains a printhead 64 mounted in a carriage 58. A carriage motor 56 moves the carriage 58 back and forth along a print medium. The carriage motor 56 in turn is driven by a motor driver 54. An interface circuit 60 is used to send and receive signals between all components of the inkjet printer 50, and a control circuit 68 is used to control operation of the inkjet printer 50. When a host computer 40 prints images on the inkjet printer 50, the host computer 40 sends print data to the interface circuit 60. The interface circuit 60 then sends the print data to a printhead driving circuit 62, which drives the printhead 64 to eject ink for printing images.

The inkjet printer 50 also contains a temperature sensor 66 for measuring a temperature of the printhead 64. The temperature sensor 66 preferably measures the temperature of the printhead 64 prior to each print swath that the printhead 64 makes. Please refer to FIG. 5 and FIG. 6. FIG. 6 is a lookup table 53 stored in a memory 52 of the inkjet printer 50. Before each swath that the printhead 64 makes, the control circuit 68 compares the temperature of the printhead 64 measured by the temperature sensor 66 with a plurality of temperature ranges in the lookup table 53. For instance a first temperature range contains temperatures greater than or equal to Temp1 and less than Temp2. Associated with the first temperature range is a velocity Vel1. According to the temperature range that the temperature of the printhead 64 falls into, the control circuit 68 determines from the lookup table 53 the proper velocity for the carriage 58. The control circuit 68 then sends this velocity information to the motor driver 54 for driving the carriage motor 56. A general trend of the lookup table 53 is that as the temperature of the printhead 64 increases, the velocity of the carriage 58 also increases.

Since the carriage 58 will be moving the printhead 64 across the print medium more quickly as the temperature of the printhead 64 increases, the printhead 64 also has to eject ink drops at a higher rate in order to create the proper images on the print medium. To ensure that the printhead 64 ejects ink drops at the proper rate, a position detector 70 is used to detect the position of the printhead 64 as it moves across the print medium. The control circuit 68 then controls the printhead driving circuit 62 to adjust the rate at which ink drops are ejected from the printhead 64 according to the position measured by the position detector.

Figure 7:
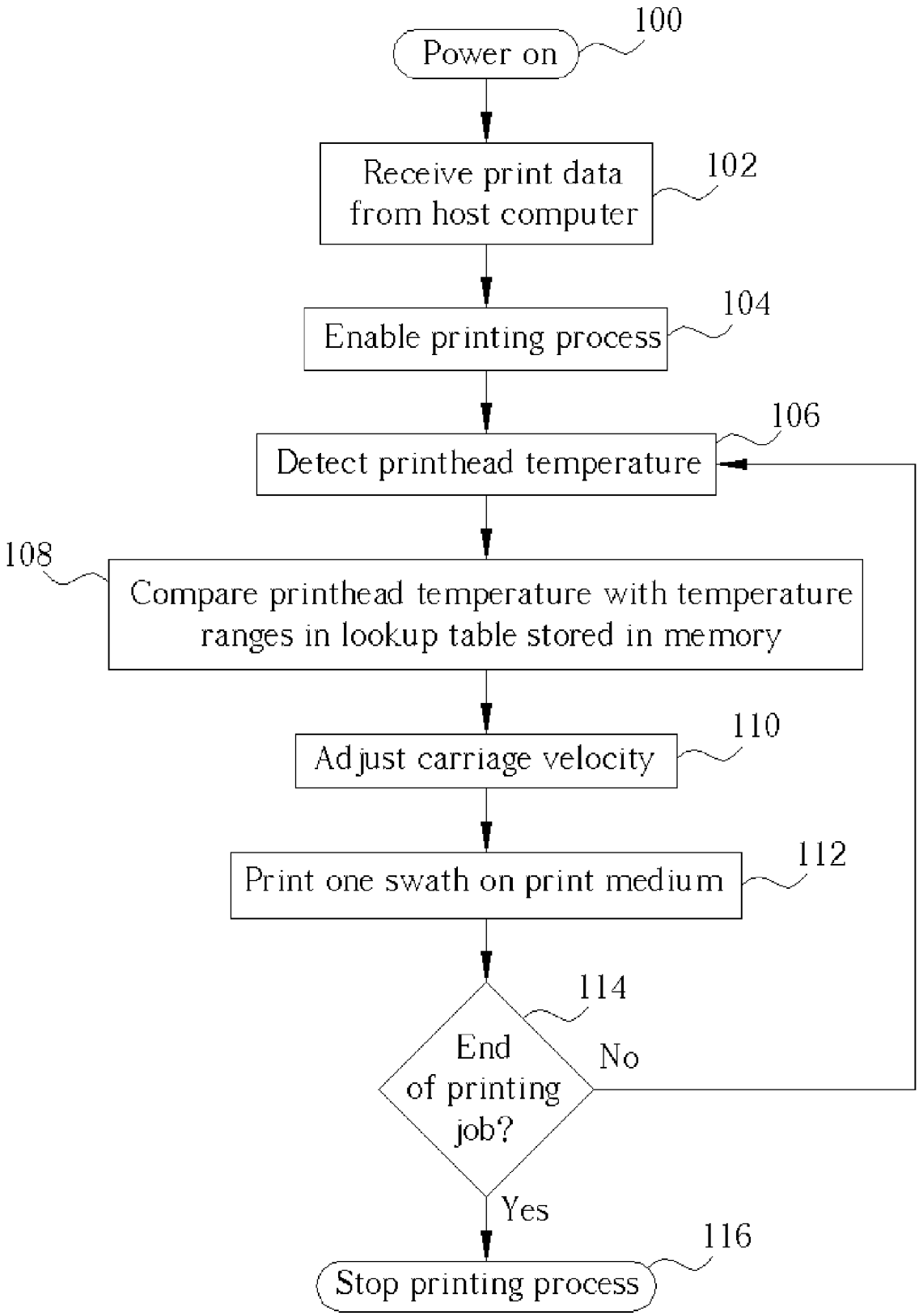
FIG. 7 is a flowchart illustrating adjusting the velocity of the carriage based on the temperature of the printhead according to the present invention.

Please refer to FIG. 7. FIG. 7 is a flowchart illustrating adjusting the velocity of the carriage 58 based on the temperature of the printhead 64 according to the present invention. Steps contained in the flowchart will be explained below.

Step 100: Power on the inkjet printer 50; Step 102: Receive print data from the host computer 40; Step 104: Enable the printing process of the inkjet printer 50; Step 106: Detect the temperature of the printhead 64 using the temperature sensor 66; Step 108: Compare the temperature of the printhead 64 with temperature ranges located in the lookup table 53 that is stored in the memory 52; Step 110: Adjust the velocity of the carriage 58 according to the velocity indicated by the lookup table 53; Step 112: Print one swath on the print medium. During each swath, individual nozzles are fired repeatedly to apply an ink pattern to the print medium; Step 114: Determine if the printing job is complete; if so, go to step 116; if not, go back to step 106; and Step 116: Stop the printing process.

As described above, the temperature of the printhead 64 is preferably measured with the temperature sensor 66 and compared with the lookup table 53 before every print swath. Of course, the temperature can also be compared at other intervals, such as every two swaths or every three swaths.

Figure 1:
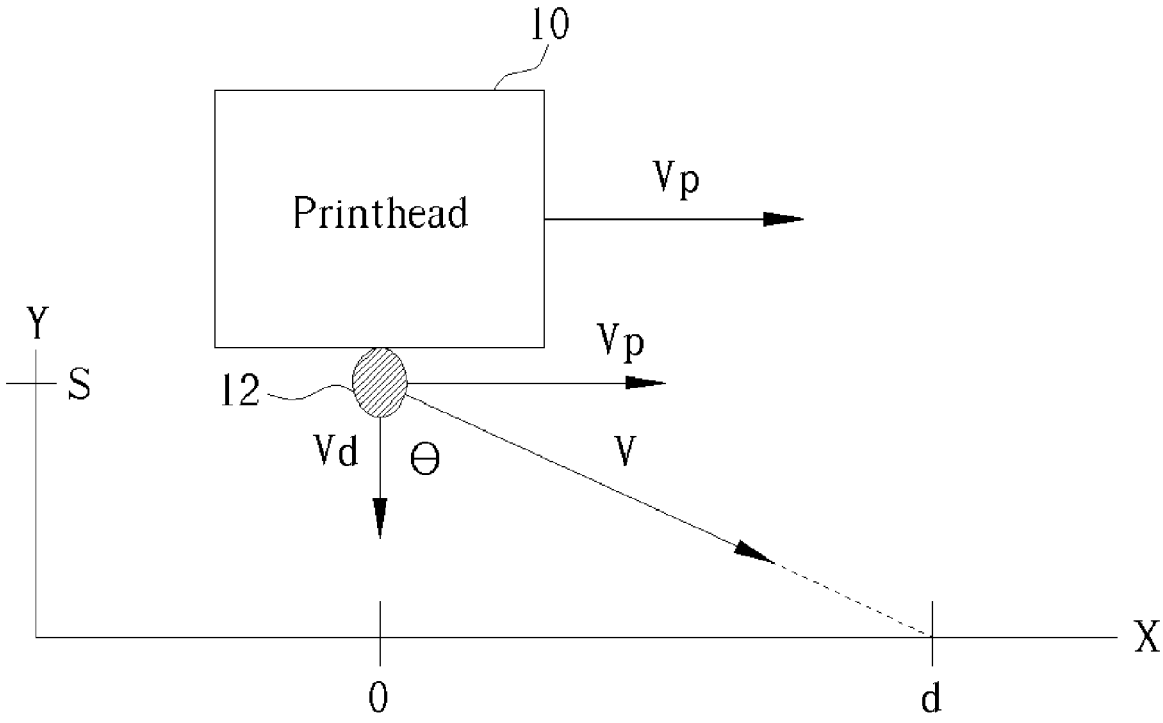
Fig. 1 Prior Art
FIG. 1 is a diagram illustrating how an ink drop is ejected from a printhead of the prior art during normal conditions.
Figure 2:
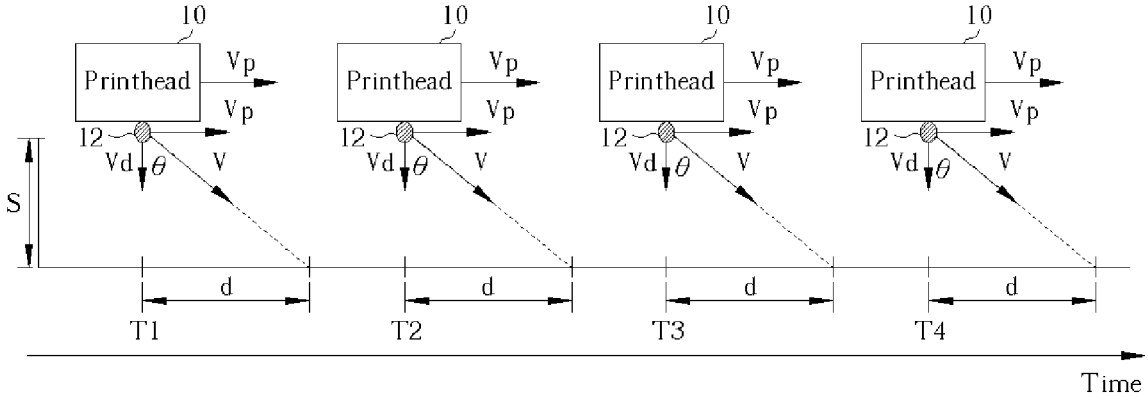
Fig. 2 Prior Art
FIG. 2 illustrates operation of the printhead over time during normal conditions.
Figure 3:
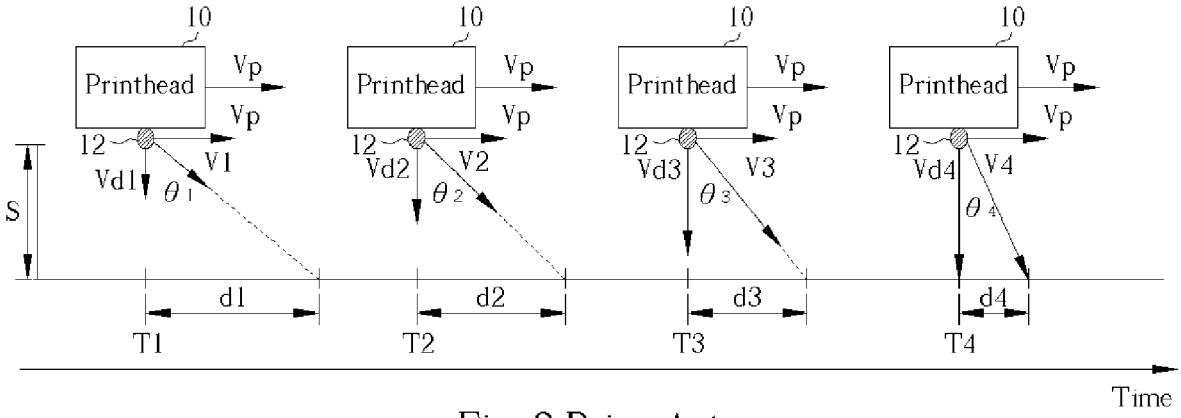
Fig. 3 Prior Art
FIG. 3 illustrates operation of the printhead over time as the temperature of the printhead rises.
Figure 4:
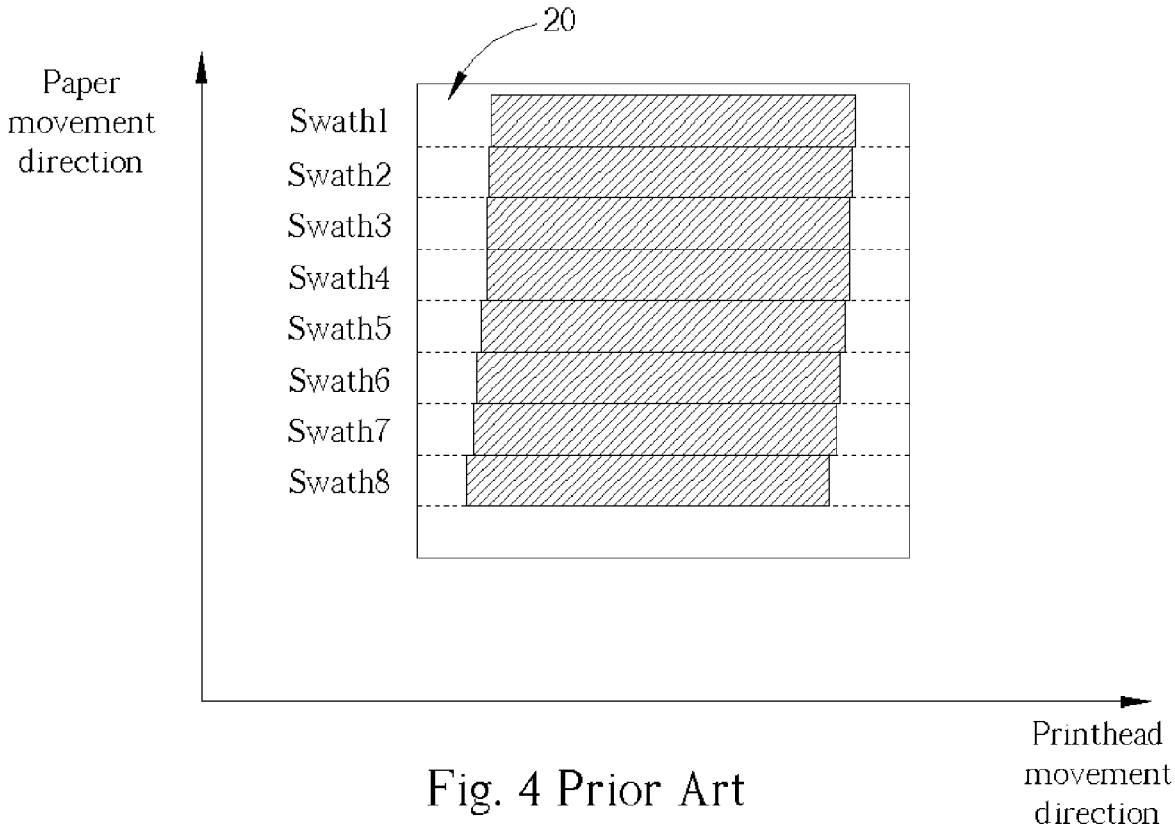
Fig. 4 Prior Art
FIG. 4 is a diagram showing degradation of print quality as the temperature of the printhead increases.
Figure 8:
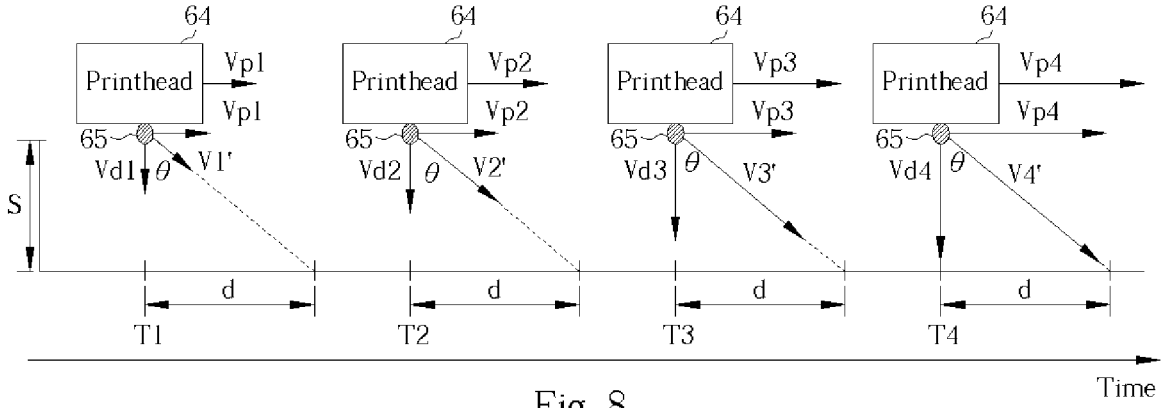
FIG. 8 illustrates operation of the printhead over time as the temperature of the printhead rises.

Please refer to FIG. 8. FIG. 8 illustrates operation of the printhead 64 over time as the temperature of the printhead 64 rises. Like FIG. 3, in FIG. 8 in each of the four time intervals T1–T4, the drop out velocities Vd1–Vd4 are not constant due to the variation in temperature of the printhead 64. To compensate for this, the velocity of the carriage 58 is adjusted to have values of Vp1–Vp4 over the time intervals T1–T4. Thus, the total velocities with which ink drops 65 are ejected from the printhead 64 are V1"–V4" for the time intervals T1–T4, respectively. A characteristic of the present invention is that the ink drops 65 are ejected from the printhead 64 at an approximately constant angle θ from the vertical. In addition, from the time that the ink drops 65 are ejected from the printhead 64 to the time that the ink drops 65 reach the surface of the print medium, the ink drops 65 have traveled a total distance of d. This distance d is substantially constant for each time interval T1–T4, even though the temperature of the printhead 64 is not constant. Since the distance d is constant throughout the printing process, the inkjet printer 50 prints images that have improved print quality compared to the prior art. Thus, the present invention will not suffer from the problem of staggered rows in the printed image, as was the case in the prior art image shown in FIG. 4.

Although the control circuit 68 preferably compares the temperature of the printhead 64 with the plurality of temperature ranges in the lookup table 53, only one reference temperature is needed to implement the present invention. If the temperature of the printhead 64 is greater than the reference temperature, then the velocity of the carriage 58 is set to be a first velocity. On the other hand, if the temperature of the printhead 64 is less than the reference temperature, the velocity of the carriage 58 is set to be a second velocity. Keeping with the spirit of the present invention, the first velocity is higher than the second velocity.

In summary, the present invention method and inkjet printer eject ink drops from the printhead at an approximately constant angle and for a substantially constant distance regardless of the temperature of the printhead. Therefore, print quality will be consistent even with variations in temperature of the printhead.

Those skilled in the art will readily observe that numerous modifications and alterations of the device may be made while retaining the teachings of the invention. Accordingly, the above disclosure should be construed as limited only by the metes and bounds of the appended claims.

The invention claimed is:

1. A method of controlling printing quality in an inkjet printer having a printhead with a plurality of nozzles, the printhead mounted in a carriage, the method comprising:

moving the carriage to repeatedly pass the printhead across a print medium in individual swaths;

firing individual nozzles repeatedly during each swath to apply an ink pattern to the print medium;

measuring the temperature of the printhead prior to each swath;

comparing the temperature of the printhead to at least one reference temperature; and if the temperature of the printhead is greater than the reference temperature, raising the velocity of the carriage during the upcoming swath for ensuring that a distance ink is ejected from the printhead to the print medium is kept substantially constant during each swath.

2. The method of claim 1 wherein comparing the temperature of the printhead to at least one reference temperature comprises consulting a lockup table containing a plurality of temperature ranges and corresponding carriage velocities, determining a current temperature range based on the measured temperature of the printhead, and adjusting the velocity of the carriage to be the carriage velocity corresponding to the current temperature range.

3. The method of claim 2 wherein the higher the temperature range in the lookup table is, the higher the corresponding carriage velocity is.

4. The method of claim 3 wherein as the temperature of the ink in the printhead increases, the velocity in which ink is ejected from the printhead increases, and raising the carriage velocity in response to higher temperatures of the printhead effectively ensures that an angle in which ink is ejected from the printhead to the print medium is kept substantially constant during each swath.

5. The method of claim 2 further comprising increasing a rate at which ink is ejected from the printhead as the carriage velocity is increased.

6. An inkjet printer that applies an ink pattern to a print medium, the printer comprising:

a printhead;

a carriage for mounting the printhead and for repeatedly passing the printhead across the print medium in individual swaths, the printhead having individual nozzles that are fired repeatedly during each swath to apply an ink pattern to the print medium;

a temperature sensor for measuring the temperature of the printhead prior to each swath; and a control circuit for comparing the temperature of the printhead to at least one reference temperature and for raising the velocity of the carriage during the upcoming swath if the temperature of the printhead is greater than the reference temperature for ensuring that a distance ink is ejected from the printhead to the print medium is kept substantially constant during each swath.

7. The inkjet printer of claim 6 further comprising a memory for storing a lookup table containing a plurality of temperature ranges and corresponding carriage velocities, wherein the control circuit consults the lookup table before each swath for determining a current temperature range based on the measured temperature of the printhead and for adjusting the velocity of the carriage to be the carriage velocity corresponding to the current temperature range.

8. The inkjet printer of claim 7 wherein the higher the temperature range in the lookup table is, the higher the corresponding carriage velocity is.

9. The inkjet printer of claim 8 wherein as the temperature of the ink in the printhead increases, the velocity in which ink is ejected from the printhead increases, and raising the carriage velocity in response to higher temperatures of the printhead effectively ensures that an angle in which ink is ejected from the printhead to the print medium is kept substantially constant during each swath.

10. A method of controlling a moving velocity of a printhead, the printhead mounted in a carriage and the carriage capable of moving the printhead back and forth, the printhead having a plurality of nozzles and the printhead capable of firing individual nozzles during each swath to apply an ink onto a print medium, the method comprising steps of:

measuring the temperature of the printhead prior to an upcoming swath;

comparing the temperature of the printhead to at least one reference temperature by consulting a lookup table containing a plurality of temperature ranges and corresponding carriage velocities;

determining a current temperature range based on the measured temperature of the printhead; and adjusting the velocity of the carriage to be the carriage velocity corresponding to the current temperature range;

wherein when the temperature of the printhead is greater than the reference temperature, the carriage moves at a first velocity during the upcoming swath, and when the temperature of the printhead is lower than the reference temperature, the carriage moves at a second velocity during the upcoming swath, the first velocity being higher than the second velocity.

11. The method of claim 10 wherein the higher the temperature range in the lookup table is, the higher the corresponding carriage velocity is.

12. The method of claim 11 wherein as the temperature of the ink in the printhead increases, the velocity in which ink is ejected from the printhead increases, and raising the carriage velocity in response to higher temperatures of the printhead effectively ensures that an angle in which ink is ejected from the printhead to the print medium is kept substantially constant during each swath.

13. The method of claim 10 further comprising increasing a rate at which ink is ejected from the printhead as the carriage velocity is increased.

* * * * *